US009993028B2

(12) United States Patent
Li et al.

(10) Patent No.: US 9,993,028 B2
(45) **Date of Patent: *Jun. 12, 2018**

(54) ATOMIZER HAVING REPLACEABLE ATOMIZING CORE AND ELECTRONIC CIGARETTE HAVING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Changzheng Dai, Shenzhen (CN); Xingbing Zou, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/404,191

(22) Filed: Jan. 11, 2017

(65) Prior Publication Data

US 2017/0119060 A1 May 4, 2017

(30) Foreign Application Priority Data

Jan. 16, 2016 (CN) ..... 2016 2 0038520
Dec. 21, 2016 (CN) ..... 2016 2 1409969

(51) Int. Cl.
*A24F 47/00* (2006.01)
*A24F 7/02* (2006.01)

(52) U.S. Cl.
CPC ..... *A24F 47/008* (2013.01); *A24F 7/02* (2013.01)

(58) Field of Classification Search
None
See application file for complete search history.

(56) References Cited

U.S. PATENT DOCUMENTS 9,603,390 B2 * 3/2017 Li ..... A24F 47/008
2016/0278163 A1 * 9/2016 Chen ..... A61M 11/042
2017/0006923 A1 * 1/2017 Li ..... A24F 47/008
2017/0065001 A1 * 3/2017 Li ..... F16K 15/14

* cited by examiner

*Primary Examiner* — Tho D Ta
(74) *Attorney, Agent, or Firm* — Cheng-Ju Chiang

(57) ABSTRACT

An exemplary atomizer includes a main body of housing, a mouthpiece, an atomizing core, an atomizing cover. The main body of housing defines a liquid chamber configured for storing tobacco liquid. The mouthpiece is detachably connected with an end of the main body of housing. The atomizing core arranged in the main body of housing. The atomizing cover is arranged in the liquid chamber. The atomizing core is arranged in the atomizing cover. The atomizing cover has a top surface, and the top surface defines at least one liquid inlet. The atomizing core includes a heating element and a liquid conducting element surrounding the heating element. The liquid conducting element is configured for absorbing tobacco liquid flowed from the at least one liquid inlet, and the heating element is configured for atomizing the tobacco liquid in the liquid conducting element.

19 Claims, 6 Drawing Sheets

ATOMIZER HAVING REPLACEABLE ATOMIZING CORE AND ELECTRONIC CIGARETTE HAVING SAME

TECHNICAL FIELD

The present invention relates to electronic cigarettes, and particularly to an atomizer and an electronic cigarette using same.

BACKGROUND ART

A typical electronic cigarette includes an atomizer and a power supply. The atomizer includes an atomizing core and a liquid chamber configured for storing tobacco liquid. The atomizing core includes a liquid conducting element and a heating element. The atomizing core is usually replaceable. However, when replacing the atomizing core, tobacco liquid in the liquid chamber may leak out, thus rendering user experience unsatisfactory.

What are needed, therefore, are an atomizer and an electronic cigarette using same, which can overcome the above shortcomings.

SUMMARY

An exemplary atomizer includes a main body of housing, a mouthpiece, an atomizing core, an atomizing cover. The main body of housing defines a liquid chamber configured for storing tobacco liquid. The mouthpiece is detachably connected with an end of the main body of housing. The atomizing core arranged in the main body of housing. The atomizing cover is arranged in the liquid chamber. The atomizing core is arranged in the atomizing cover. The atomizing cover has a top surface, and the top surface defines at least one liquid inlet. The atomizing core includes a heating element and a liquid conducting element surrounding the heating element. The liquid conducting element is configured for absorbing tobacco liquid flowed from the at least one liquid inlet, and the heating element is configured for atomizing the tobacco liquid in the liquid conducting element.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
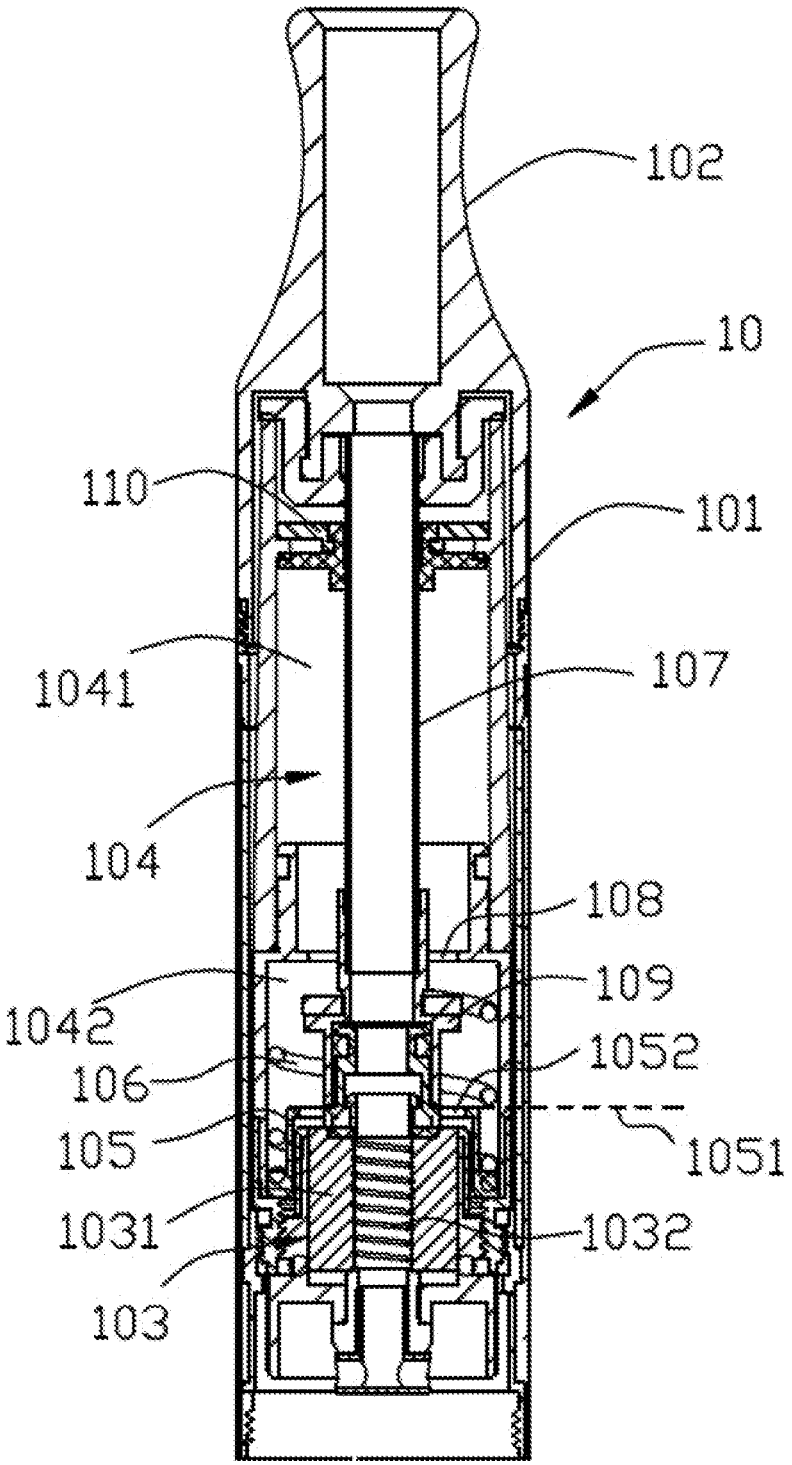
FIG. 1 is a cross-sectional view of an atomizer according to a first embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Referring to FIG. 1, an atomizer 10 is shown. The atomizer 10 includes a main body of housing 101, and a mouthpiece 102 detachably connected to an end of the housing 101, and an atomizing core 103 in the main body of housing 101. The main body of housing 101 includes a liquid chamber 104 configured (i.e., structured and arranged) for storing tobacco liquid. The main body of housing 101 includes a housing and a shell of a liquid cup in the housing, and the liquid chamber 104 is defined in the shell of the liquid cup. An atomizing cover 105 is provided in the liquid chamber 104, and is positioned at a bottom part of the liquid chamber 104. The atomizing core 103 is arranged in the atomizing cover 105. An air pipe 107 is further provided in the liquid chamber 104, and two opposite ends of the air pipe 107 are connected to the mouthpiece 102 and the atomizing cover 105, respectively. The atomizing cover 105 includes a top surface 1051 defining at least one liquid inlet 1052. The atomizing core 103 includes a heating element 1032 and a liquid conducting element 1031 surrounding the heating element 1032. The liquid conducting element 1031 is configured for absorbing tobacco liquid, which flows in from the liquid inlet 1052. The heating element 1032 heats the tobacco liquid to form aerosol, the aerosol passes through the air pipe 107 and reaches the mouthpiece 102.

Quite usefully, the liquid conducting element 1031 is an annular hollow structure, and the heating element 1032 is in contact with an internal wall of the liquid conducting element 1031. The liquid conducting element 1031 and the heating element 1032 are oriented along an axial direction of the atomizer 10. An internal space of the liquid conducting element 1031 is in communication with the air pipe 107. A top part of the liquid conducting element 1031 is adjacent to the liquid inlet 1052, the tobacco liquid permeates from the top part to a bottom part, and from an external wall to the internal wall. In the present embodiment, the liquid conducting element 1031 may be made of fiber cotton, or micro porous ceramic, and the heating element is a spiral heating wire.

Figure 2:
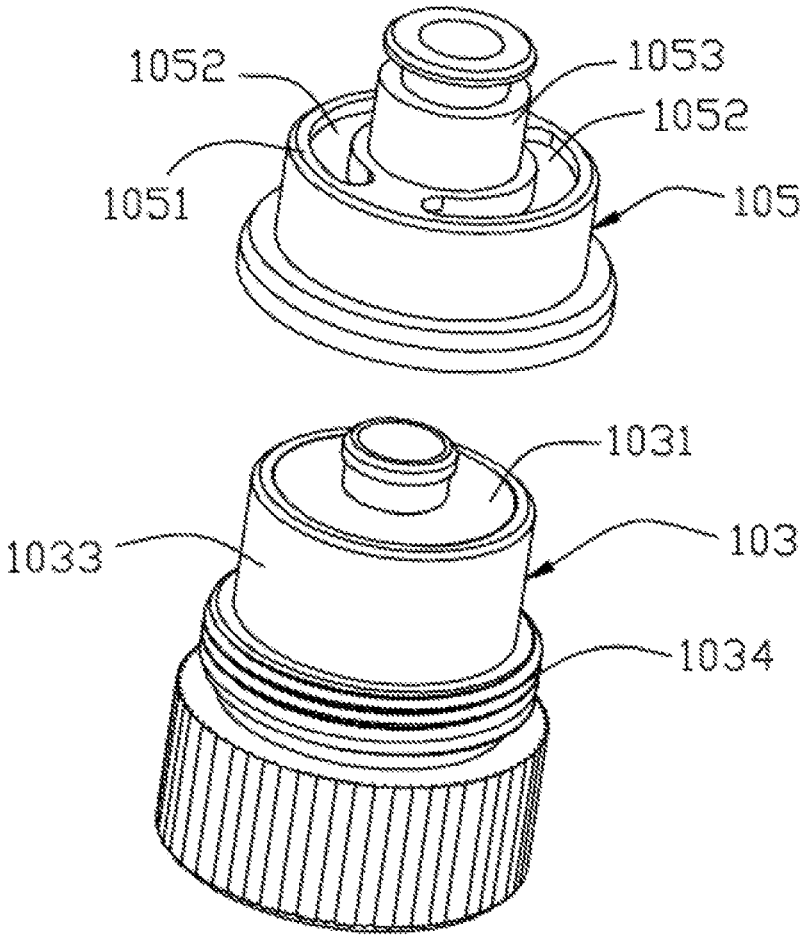
FIG. 2 is a perspective view of an atomizing core and an atomizing cover of FIG. 1 when separated from each other.

Referring to FIG. 2, the atomizing core 103 includes a holder 1033 configured for supporting the liquid conducting element 1031 and the heating element 1032. The holder 1033 includes a plurality of screw threads 1034 configured for connecting with the main body of housing 101. When the holder 1033 and the main body of housing 101 are connected with each other, the liquid conducting element 1031 and the heating element 1032 are kept inside the atomizing cover 105. It is to be understood that the holder 1033 can be connected directly with a bottom part of the atomizing cover 105. An electrode is further provided at a bottom part of the holder 1033, and the electrode is configured for connecting a power supply.

The atomizing cover 105 defines an atomizing chamber, the atomizing core 103 is received in the atomizing chamber, and the liquid inlet is defined in a top surface 1051 of the atomizing cover 105. In the present embodiment, the atomizing cover 105 defines two symmetric liquid inlets 1052. The atomizing cover 105 further includes a tubular connecting end 1053 extending axially from the top surface 1051 of the atomizing cover 105. The tubular connecting end 1053 is hermetically coupled with a bottom end of the air pipe 107. A bottom end of the atomizing cover 105 is hermetically coupled to the main body of housing 101 via a sealing ring, preventing tobacco liquid in the liquid chamber 104 from leaking into the atomizing chamber via other positions except the liquid inlet 1052.

Figure 3:
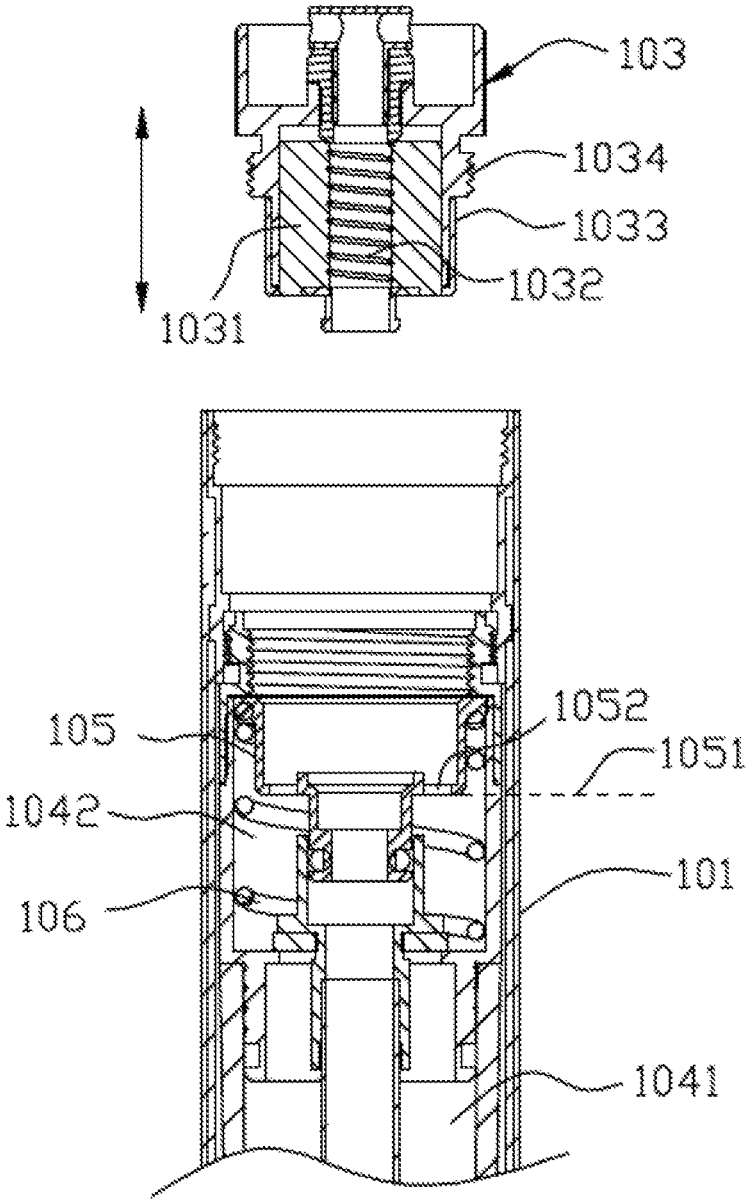
FIG. 3 is a cross-sectional view of the atomizer of FIG. 1 in an inverted state when the atomizing core is taken out.

Referring to FIG. 3, when replacing the atomizing core 103, the atomizer 10 is first inverted, the atomizing core 103 is detached from the main body of housing 101, and is then taken out from the atomizing cover 105. In this position, a liquid level of the tobacco liquid in the liquid chamber 104 is usually lower than or coplanar with the top surface 1051 of the atomizing cover 105, avoiding tobacco liquid leakage from the atomizing cover 105.

Referring to FIG. 1 again, an isolation wall is provided in the liquid chamber 104, and the liquid chamber 104 is divided into a first liquid chamber 1041 and a second liquid chamber 1042 by the isolation wall. The isolation wall defines a through hole, the air pipe 107 passes through the through hole. The first liquid chamber 1041 and the second liquid chamber 1042 are arranged from top to bottom along an axial direction. A liquid hole 108 is defined between the air pipe 107 and the isolation wall. The atomizing cover 105 and the atomizing core 103 are arranged in the second liquid chamber 1042. When the liquid hole 108 is not obstructed, the first liquid chamber 1041 is in liquid communication with the second liquid chamber 1042.

Quite usefully, the air pipe 107 is movable along an axial direction, a top end of the air pipe 107 is connected to the mouthpiece 102, and a bottom end of the air pipe 107 is connected to a sealing part 109. The sealing part 109 is configured for sealing the liquid inlet 108. A bottom part of the sealing part 109 abuts against an elastic element. In the present embodiment, the elastic element 106 is a spring. The sealing part 109 includes a flange, a sealing gasket is provided on the flange. When the sealing part 109 is moved upwards, the flange and the sealing gasket seal the liquid hole 108, and the spring abuts against a bottom surface of the flange. Referring to FIG. 1, when the mouthpiece 102 is assembled to the main body of housing 101, the mouthpiece 102 pushes the air pipe 107 and the sealing part 109 to move downwards, the elastic element 106 is compressed, and the liquid hole 108 is opened. In this position, the tobacco liquid in the first liquid chamber 1041 flows into the second liquid chamber 1042, so that the atomizing core 103 can absorb tobacco liquid from the second liquid chamber 1042.

Figure 4:
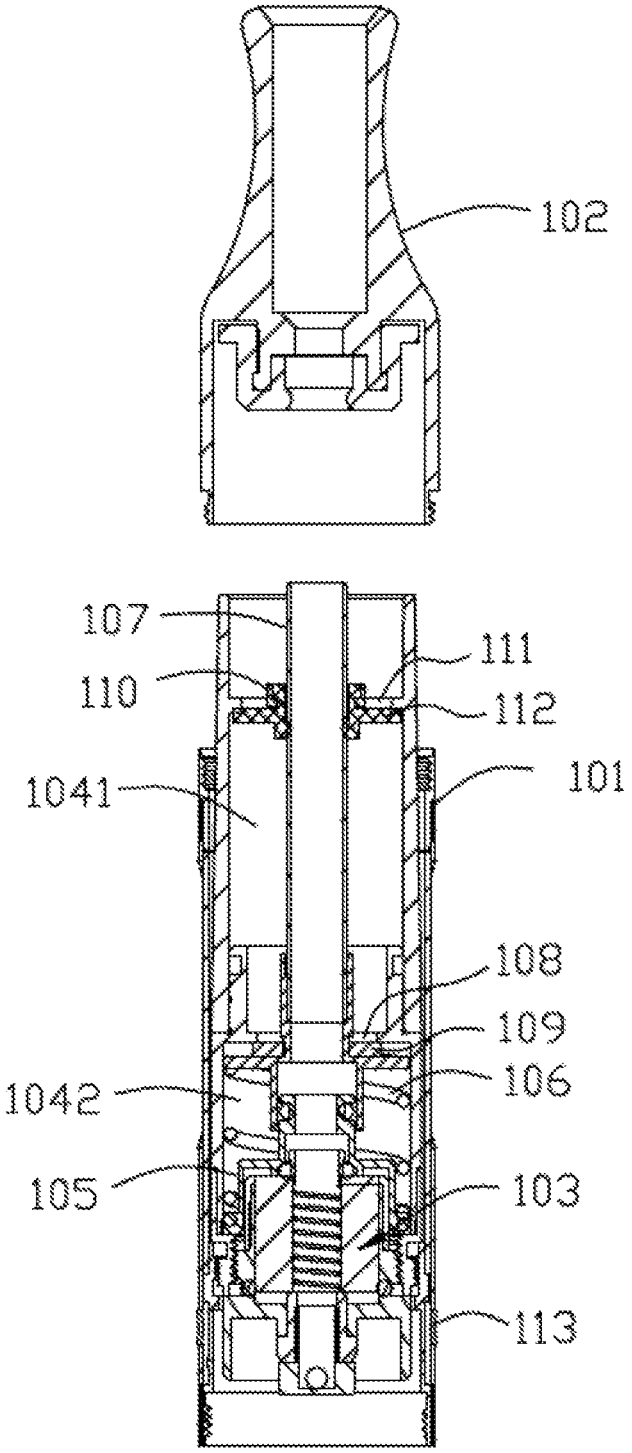
FIG. 4 is a cross-sectional view of the atomizer of FIG. 1 when a mouthpiece is detached from the main body of housing.

Referring to FIG. 4, when the mouthpiece 102 is detached, the air pipe 107 is driven to move upwards by the elastic element 106, and the sealing part 109 abuts against a bottom surface of the isolation wall and seals the liquid inlet 108. In this position, tobacco liquid in the first liquid chamber 1041 cannot flow into the second liquid chamber 1042. The main body of the housing 101 includes a positioning part 110 inside adjacent to the mouthpiece. The positioning part 110 is configured for guiding the air pipe 107 to move axially. A bottom part of the air pipe 107 is connected to the tubular connecting part 1053. The positioning part 110 and the main body of housing 101 cooperatively define a liquid injecting hole 111, which is in communication with the first liquid chamber 1041. In liquid injecting progress, the mouthpiece 102 is detached, and then tobacco liquid can be injected into the first liquid chamber 1041 via the liquid injecting hole 111. In this state, the first liquid chamber 1041 is isolated from the second liquid chamber 1042, thus avoiding liquid leakage from the atomizing core in the second liquid chamber 1042.

Quite usefully, a sealing piece 112 is further provided on the positioning part 110. The sealing piece 112 is configured for sealing the liquid injecting hole 111, and is deformable. The sealing piece 112 is made of silicone, and is circular. The sealing piece 112 nests the air pipe 107. During liquid injecting process, an injector can push the sealing piece 112 open and insert into the first liquid chamber 1041. After finishing injecting, the sealing piece 112 restores to its original shape and seals the liquid injecting hole 111. Accordingly, liquid leakage is prevented when the atomizer 10 is turned over during liquid injecting process.

Figure 5:
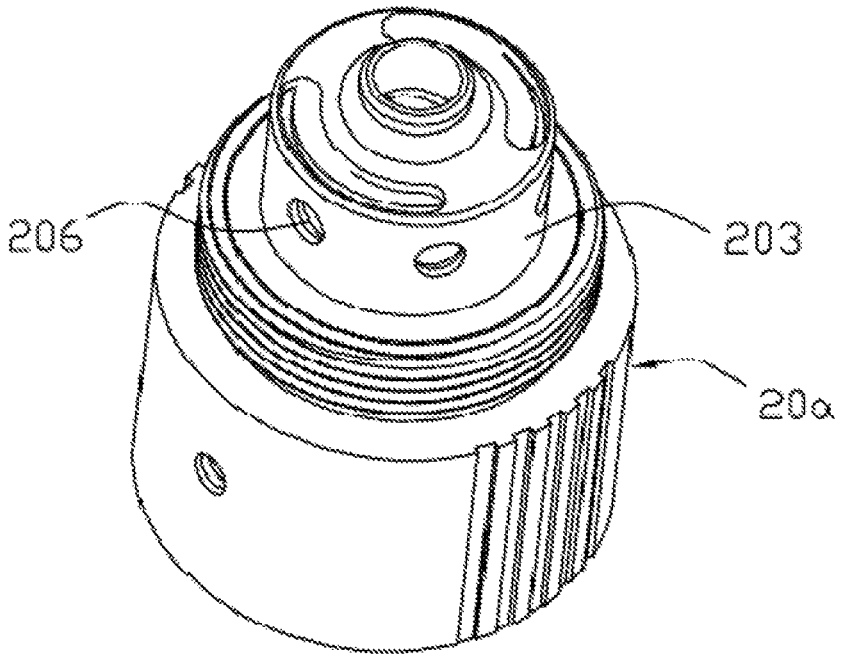
FIG. 5 is an assembled perspective view of an atomizing core and an atomizing cover according to a second embodiment.

Referring to FIG. 5, an atomizing core **20*a* and an atomizing cover 203 according to a second embodiment are shown. The atomizing core 20*a* and the atomizing cover 203 are substantially similar to those of the first embodiment, except that the atomizing cover 203 further defines a plurality of openings 206 in a sidewall. The openings 206 are in communication with an internal space of the atomizing cover 203, so that tobacco liquid can flow into the atomizing core 20*a* from different directions. Accordingly, the tobacco liquid can flow into the atomizing core 20*a* more smoothly. It is to be noted that in the atomizer 10 of the first embodiment, the atomizing cover 105 and the atomizing core 103 may be replaced by the atomizing cover 203 and the atomizing core 20*a*** in accordance with the present embodiment.

Figure 6:
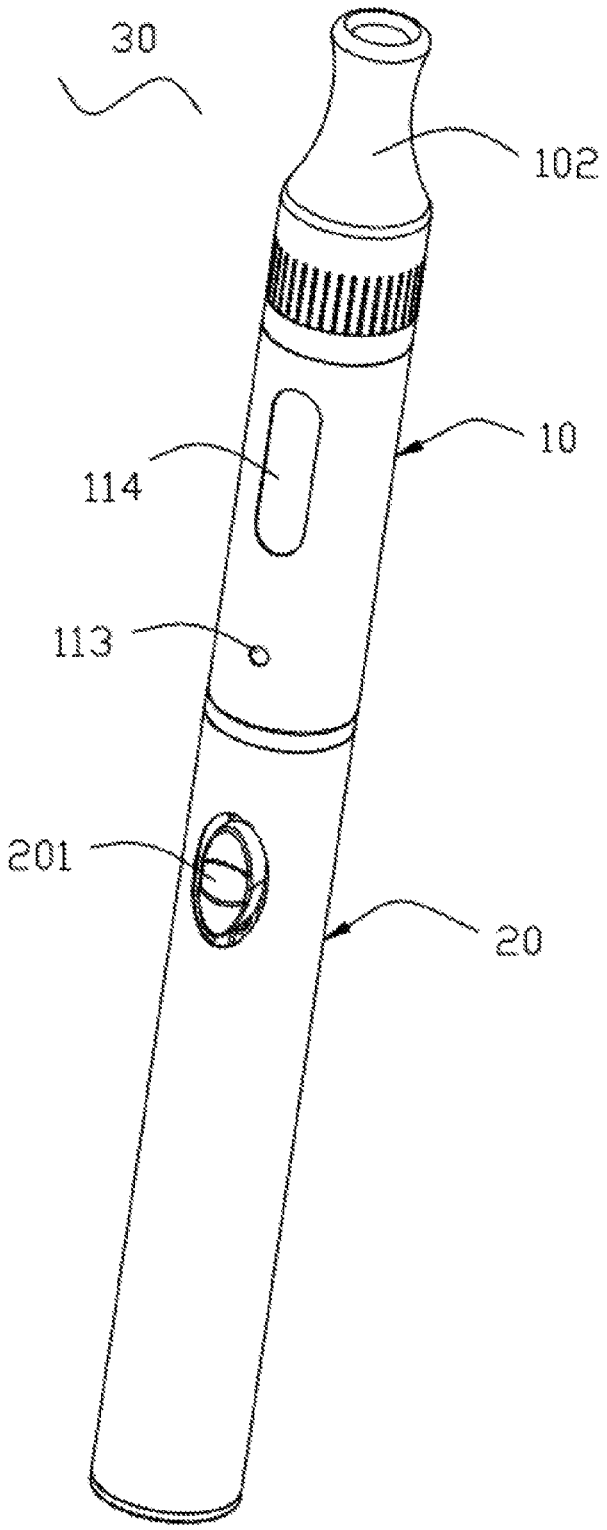
FIG. 6 is a perspective view of an electronic cigarette according to a third embodiment.

Referring to FIG. 6, an electronic cigarette 30 is shown. The electronic cigarette 30 includes the above-described atomizer 10 and a power supply 20 detachably connected with the atomizer 10. The power supply 20 includes a button 201 configured for turning on/off the atomizer 10. The atomizer 10 defines an air inlet 113, so that external air can enter the atomizer 10 via the air inlet 113.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer, comprising:

a main body of housing defining a liquid chamber configured for storing tobacco liquid;

a mouthpiece detachably connected with an end of the main body of housing;

an atomizing core arranged in the main body of housing; and an atomizing cover arranged in the liquid chamber, the atomizing core being arranged in the atomizing cover, the atomizing cover having a top surface, the top surface defining at least one liquid inlet;

the atomizing core comprising a heating element and a liquid conducting element surrounding the heating element, the liquid conducting element being configured for absorbing tobacco liquid flowed from the at least one liquid inlet, and the heating element being configured for atomizing the tobacco liquid in the liquid conducting element.

2. The atomizer according to claim 1, wherein the liquid conducting element is an annular hollow structure, the heating element contacts with an inner wall of the liquid conducting element; the liquid conducting element and the heating element are arranged along an axial direction of the atomizer.

3. The atomizer according to claim 2, wherein the liquid conducting element is made of fiber cotton or micro porous ceramic, and the heating element comprises a spiral heating wire.

4. The atomizer according to claim 1, wherein the atomizing core further comprises a holder configured for supporting the liquid conducting element and the heating element, and keeping the liquid conducting element and the heating element in the atomizing cover; the holder is detachable connected with the main body of housing.

5. The atomizer according to claim 1, wherein the liquid chamber is divided into a first liquid chamber and a second liquid chamber, the atomizer further comprises a liquid hole defined between the first liquid chamber and the second liquid chamber, and the atomizing cover and the atomizing core are arranged in the second liquid chamber.

6. The atomizer according to claim 5, further comprising an air pipe in the liquid chamber, a sealing part, an elastic element, wherein the air pipe is movable along an axial direction thereof, a top end of the air pipe is connected with the mouthpiece, a bottom end of the air pipe is connected with the sealing part, the sealing part is configured for sealing the liquid hole, the elastic element abuts against a bottom part of the sealing part; when the mouthpiece is assembled to the main body of housing, the mouthpiece pushes the air pipe to move downwards, so that the sealing part opens the liquid hole; when the mouthpiece is detached, the air pipe is driven by the elastic element to move upwards, so that the sealing part seals the liquid hole.

7. The atomizer according to claim 6, wherein the main body of housing comprises a positioning part adjacent to the mouthpiece, the positioning part is configured for guiding the air pipe to move axially, the positioning part and the main body of housing cooperatively define a liquid injecting hole, and the liquid injecting hole is in communication with the first liquid chamber.

8. The atomizer according to claim 7, further comprising a sealing piece provided on the positioning part, wherein the sealing piece is configured for sealing the liquid injecting hole, and is deformable.

9. The atomizer according to claim 6, wherein the atomizing cover comprises a tubular connecting end on the top surface, and the tubular connecting end is hermetically coupled with the bottom end of the air pipe.

10. The atomizer according to claim 1, wherein the atomizing cover further comprises a sidewall defining a plurality of openings.

11. An electronic cigarette comprising:

an atomizer according to claim 1; and a power supply configured for supplying the atomizer power.

12. The electronic cigarette according to claim 11, wherein the liquid conducting element is an annular hollow structure, the heating element contacts with an inner wall of the liquid conducting element; the liquid conducting element and the heating element are arranged along an axial direction of the atomizer.

13. The electronic cigarette according to claim 11, wherein the atomizing core further comprises a holder configured for supporting the liquid conducting element and the heating element, and keeping the liquid conducting element and the heating element in the atomizing cover; the holder is detachable connected with the main body of housing.

14. The electronic cigarette according to claim 11, wherein the liquid chamber is divided into a first liquid chamber and a second liquid chamber, the atomizer further comprises a liquid hole defined between the first liquid chamber and the second liquid chamber, and the atomizing cover and the atomizing core are arranged in the second liquid chamber.

15. The electronic cigarette according to claim 14, wherein the atomizer further comprises an air pipe in the liquid chamber, a sealing part, an elastic element; the air pipe is movable along an axial direction thereof, a top end of the air pipe is connected with the mouthpiece, a bottom end of the air pipe is connected with the sealing part, the sealing part is configured for sealing the liquid hole, the elastic element abuts against a bottom part of the sealing part; when the mouthpiece is assembled to the main body of housing, the mouthpiece pushes the air pipe to move downwards, so that the sealing part opens the liquid hole; when the mouthpiece is detached, the air pipe is driven by the elastic element to move upwards, so that the sealing part seals the liquid hole.

16. The electronic cigarette according to claim 15, wherein the main body of housing comprises a positioning part adjacent to the mouthpiece, the positioning part is configured for guiding the air pipe to move axially, the positioning part and the main body of housing cooperatively define a liquid injecting hole, and the liquid injecting hole is in communication with the first liquid chamber.

17. The electronic cigarette according to claim 16, further comprising a sealing piece provided on the positioning part, wherein the sealing piece is configured for sealing the liquid injecting hole, and is deformable.

18. The electronic cigarette according to claim 15, wherein the atomizing cover comprises a tubular connecting end on the top surface, and the tubular connecting end is hermetically coupled with the bottom end of the air pipe.

19. The electronic cigarette according to claim 11, wherein the atomizing cover further comprises a sidewall defining a plurality of openings.

* * * * *